US005823365A

United States Patent [19]

Page

[11] Patent Number: 5,823,365

[45] Date of Patent: Oct. 20, 1998

[54] BALLOON HOLDER AND METHOD FOR DISPLAYING AND HOLDING BALLOONS

[76] Inventor: Gary W. Page, 4809 Pineridge Rd., Charlotte, N.C. 28226

[21] Appl. No.: 721,691

[22] Filed: Sep. 26, 1996

[51] Int. Cl.[6] ..... A47F 5/08

[52] U.S. Cl. ..... 211/113; 211/13.1

[58] Field of Search ..... 211/13.1, 60.1, 211/113, 115; 248/333, 512

[56] References Cited

U.S. PATENT DOCUMENTS

| | | | |
|---|---|---|---|
| 495,409 | 4/1893 | Fry | 211/115 |
| 908,548 | 1/1909 | Cloud | 211/115 |
| 2,560,228 | 7/1951 | Kosorok | 211/60.1 X |
| 3,135,389 | 6/1964 | Farley | 211/115 X |
| 3,574,498 | 4/1971 | Zarinsky | 248/512 X |
| 5,016,848 | 5/1991 | Metz . | |
| 5,024,011 | 6/1991 | Collins | 211/13.1 X |
| 5,036,985 | 8/1991 | Lovik | 211/13.1 |
| 5,074,510 | 12/1991 | Metz . | |
| 5,315,784 | 5/1994 | Henehan | 248/333 X |
| 5,435,979 | 7/1995 | Miller et al. | 211/60.1 X |
| 5,509,540 | 4/1996 | Pomerantz . | |

*Primary Examiner*—Jose V. Chen

*Attorney, Agent, or Firm*—Kennedy, Covington, Lobdell, & Hickman, LLP

[57] ABSTRACT

A ceiling-mounted balloon holder that removably retains balloons and the like at a predetermined distance below the ceiling and above the fixtures located upon the floor. The balloon holder has a base located above the fixtures such that the base is accessible to a person standing on the floor without disrupting the fixtures. The base has a structure for removably retaining balloons that have sticks or string-like elements attached to them and that are filled either with helium or another gas. There is also a structure for suspending the base from the ceiling at such predetermined distance below the ceiling to enable the base to be positioned between the ceiling and the top of the fixture located on the floor. A method of removably retaining balloons and the like is also disclosed.

19 Claims, 3 Drawing Sheets

BALLOON HOLDER AND METHOD FOR DISPLAYING AND HOLDING BALLOONS

BACKGROUND OF THE INVENTION

The present invention relates to a balloon holder and, more particularly, to a balloon holder to display balloons for sale that is easily accessible to a customer.

It has long been known in the retail sales industry that sales of items are greatly enhanced if the items are displayed so that customers may see items before purchase, and if the items are easily accessible for the customer to remove from the display. For impulse buying items, it is particularly advantageous to locate such displays near where a potential customer is likely to pass regardless of whether they are looking for the specific item that is to be displayed.

Balloons are one type of retail merchandise that are subject to impulse buying. Sales of balloons, particularly those with imprinted designs, are often the result of a potential customer seeing the balloons displayed and becoming visually attracted to the balloons. Because of the visual attraction, the consumer removes the balloon from the holder and proceeds to purchase the merchandise.

In order to take full advantage of the benefits from displaying balloons so that customers will be visually attracted and, thus, purchase the merchandise, it is desirable to provide a holder for the balloons that displays them in a manner that will maximize the sales of the balloons. One method for holding helium-filled balloons that is presently used is suspension of a cage-type element with an open bottom area so that helium-filled balloons may be placed within the cage, with ribbons, strings, or the like attached to the balloons and hanging down such that a potential customer may reach them. The sides and top of the cage restrain the helium-filled balloons so that they are retained in a single location. One problem with this method of displaying balloons is that it is not always possible for the customer to reach the strings, ribbons, or the like hanging from the balloons because of the differences in the lengths of these strings. Also, the natural rotation of the balloons within the cage may result in the strings being lifted above the reach of the customer. Also, the sides of the cage and the surrounding balloons will tend to obscure the view of designs that are imprinted upon such balloons, resulting in a lessened likelihood that the balloons will be seen by the customer and subsequently purchased.

Another method for display of helium-filled balloons is disclosed in U.S. Pat. No. 5,074,510 issued to Metz wherein a balloon holder has an arch-shaped ring member formed with a base member and the base member rests on the floor or a shelf. The string or ribbon attached to the balloon is then tied or otherwise attached to this ring member, and the helium-filled balloon is then displayed above this base. One of the problems with this device is that it requires floor space or shelf space upon which the base member to which the balloons are attached must be placed. Thus, this particular floor or shelf space is then unavailable for display of any other items. As discussed above, in the retail industry, it is important to display items for sale and, thus, it is important to maximize the number of displays in the available floor space. Another problem with this device is that the balloons must be untied or cut from the ring member in order to purchase the balloon. This requires extra effort on the part of the customer beyond merely grabbing the item and proceeding to purchase it. Thus, this balloon holder is unsuitable for display of balloons for sale.

Neither of the devices discussed above contain any provisions for holding or displaying balloons that are not filled with lighter-than-air gas, such as helium. Often, balloons are simply filled with air and attached to a stick, the stick serving as the manner in which the balloon is held or inserted into a display device for an aesthetically pleasing balloon arrangement or for sale.

U.S. Pat. No. 5,509,540 issued to Pomerantz provides a holder for balloons, flowers, or the like on sticks wherein the sticks are tightly held within a receptacle and the receptacle is attached to a mounting surface, which, in turn, is attached to a vertical wall or fixture. The receptacle is tapered downwardly from an entrance towards a bottom portion so that differing sizes of sticks may be securely inserted into the receptacle. This device again consumes space that could easily be used for display of other goods. Also, the receptacles are not appropriately designed to secure more than one balloon stick, so only one balloon per receptacle may be displayed. Further, this device makes no provision for display of balloons that do not have sticks, but are attached to strings, ribbons, or the like and is unsuitable for display of balloons that are filled with lighter-than-air gas because of the tendency of such balloons to float away, even if attached to a stick.

It is desirable to provide a balloon display that displays balloons filled with any gas without using floor space, shelf space, or other space that may be effectively utilized to display other retail items, that displays balloons with sticks, strings, ribbons, etc., all in one display device, displaying the balloons such that the visual perception by potential customers is maximized in order to increase sales of the balloons. It is further desirable to provide the ability to display the balloons in high sales volume areas without displacing existing sales displays, and to provide means for the customer to easily remove the balloons from the holder in order to maximize the potential for sales of the balloons.

SUMMARY OF THE INVENTION

It is an object of the present invention to provide a balloon display without using floor space, shelf space, or other space that may be used to display other items. It is a further object of the present invention to provide a balloon display that displays the balloons filled with any gas that are attached to sticks, strings, ribbons, or the like all in one display holder and that displays balloons in such a way to maximize the visual perceptions by the customers. It is another object of the present invention to provide the ability to display balloons in high sales volume areas without displacing any existing retail displays in those locations, and to provide a means for the customers to easily remove the balloons from the balloon display holder.

Briefly summarized, the invention is a ceiling-mounted balloon holder to removably retain balloons and the like at a predetermined distance below the ceiling and at a location above fixtures that extend upwardly from a floor. The balloon holder has a base that is suspendable from the ceiling at a predetermined distance therebelow and disposed above the fixtures so that it is accessible to a person standing on the floor without disrupting the fixtures. Preferably, the base is a polyhedron and more preferably an octagonal prism.

The base also has a plurality of tubes attached thereto having a size and angular disposition for receiving and holding sticks attached to balloons, and also has attached thereto at least one coiled spring having a plurality of coils spaced from one another at a distance that will retain between the coils a string, ribbon, or the like attached to at least one balloon. The balloon holder also has a vertical member for suspending the base from the ceiling to the predetermined distance below the ceiling that includes a telescoping rod having a length which is selectively determinable.

Also disclosed is a method for removably retaining balloons and the like at a predetermined distance below the ceiling and above the fixture, including installing a ceiling mount on the ceiling and attaching an end of a vertical member to the ceiling mount. The length of the vertical member is selected to have a predetermined value such that the end of the vertical member not attached to the ceiling mount is disposed just above the fixture. This end of the vertical member is attached to a balloon holder base and balloons are attached to the balloon holder base so that the balloons are disposed above the base and are selectively removable from the holder.

DESCRIPTION OF THE PREFERRED EMBODIMENT

Figure 1:
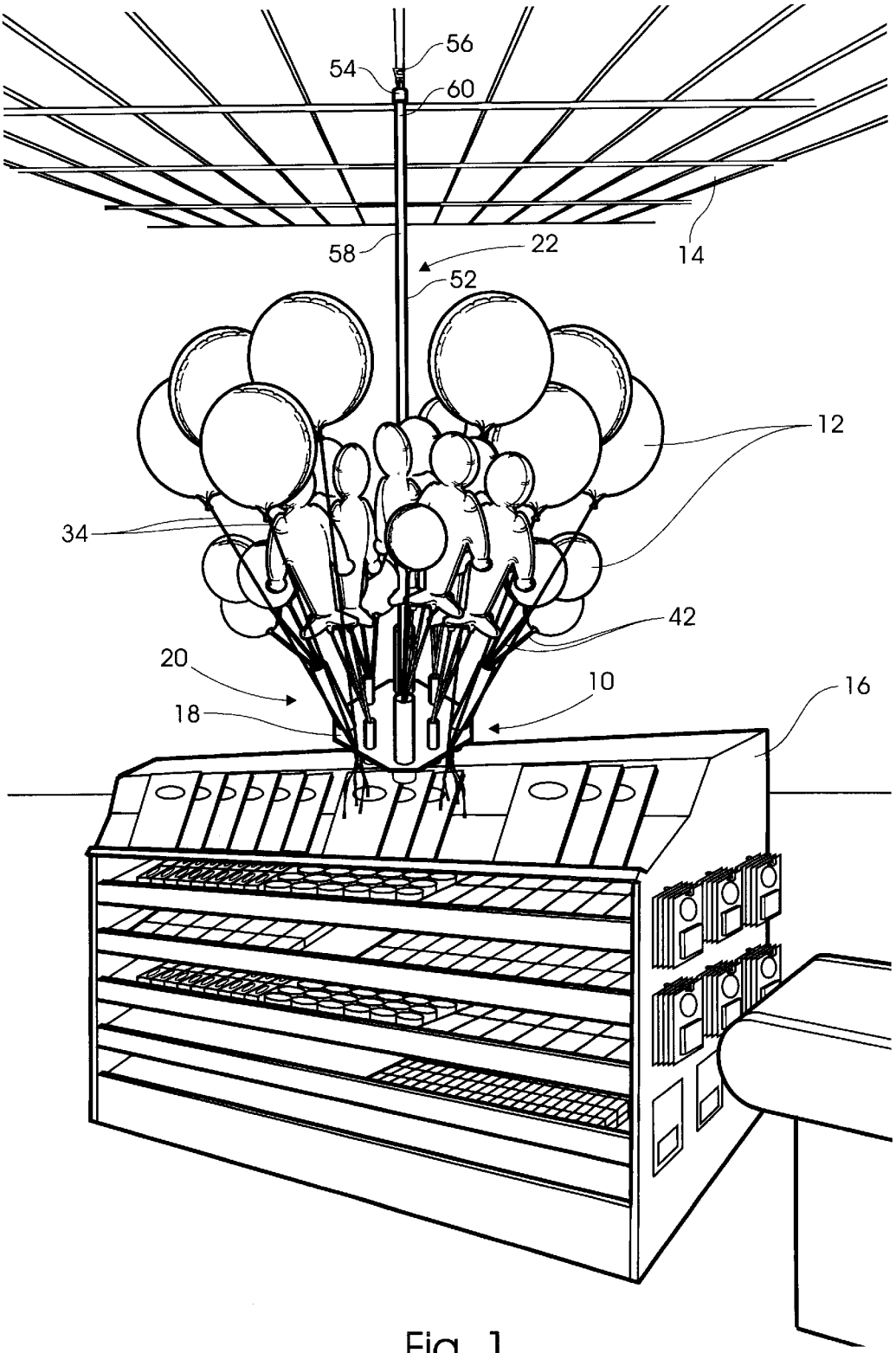
FIG. 1 is a perspective view of the present invention illustrating its placement above an existing fixture.

As illustrated in the accompanying drawings, the balloon holder 10 of the present invention removably retains balloons 12 and the like at a predetermined distance below a ceiling 14 and a location above fixtures 16 that extend upwardly from a floor. As most easily seen in FIG. 1, the balloon holder 10 includes a base 18 suspendable from the ceiling 14 and disposed above the fixture 16 such that the base 18 is accessible to a person standing on the floor without disrupting the fixture 16.

Figure 2:
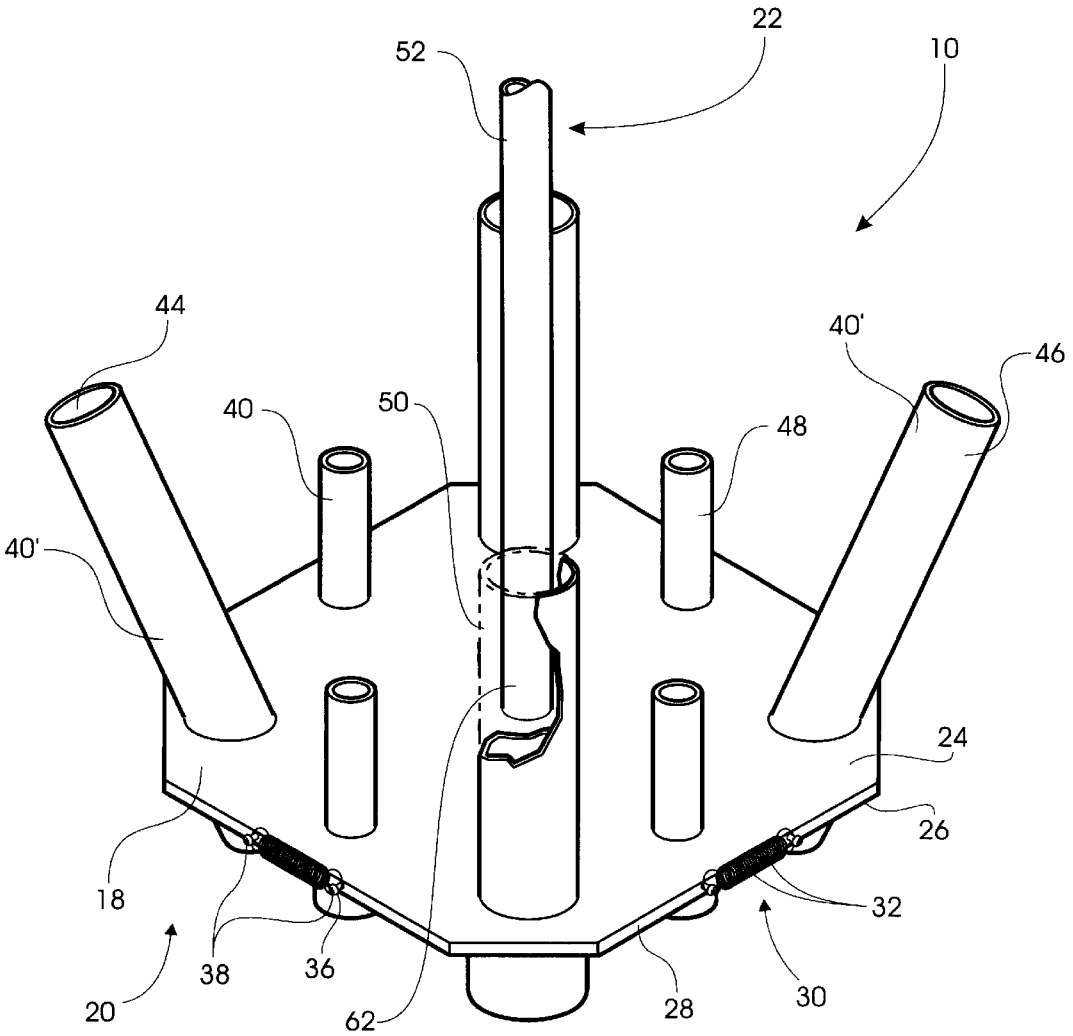
FIG. 2 is a perspective view of the balloon holder of the present invention.

As best seen in FIG. 2, the base 18 is a polyhedron with two parallel, congruent faces and all other faces being parallelograms. Preferably, the base 18 is generally an octagonal prism with a first face 24 disposed toward the ceiling 14 and a second face 26 disposed away from the ceiling 14 and an edge region 28 thereabout. When suspended, the first face 24 and second face 26 are disposed generally parallel to the ceiling 14.

A structure 20 for removably retaining the balloons 12 includes at least one coiled spring 30 having a plurality of coils 32 spaced from one another at a distance that will retain a string-like element or tether 34 that is attached to at least one of the balloons 12 (see FIG. 1). Preferably, the springs 30 are attached to the base 18 at the edge region 28 by fastening means 36, such as screws 38 that are secured to the edge region 28 and sufficiently protrude from the edge region 28 to allow one or more coils 32 to be looped around the screws 38 to retain the spring 30 upon the base 18.

Preferably, the retaining structure 20 also includes a plurality of tubes 40 having a size and angular disposition for receiving and holding sticks or tether 42 that are attached to the balloons 12 (see FIG. 1). The tubes 40 generally extend toward the ceiling 14 with an end 44 open to accommodate insertion of the sticks 42. The tubes 40 preferably include at least one tube 46 with a first diameter and at least one other tube 48 with a second diameter. The specific dimensions of the diameter, length, thickness, etc., of the tubes 40, may be modified as desired to accommodate particular circumstances without departing from the spirit of the invention. It is to be noted that the tubes 40 with greater length may be able to accommodate sticks 42 of greater length, and that more sticks 42 may be placed into tubes 40 with a larger diameter.

Each tube 40 is attached to or connected to the base 18 such that when the sticks 42 are inserted into the open end 44 of the tubes 40, the balloons 12 will be suspended from the ceiling 14 and above the fixtures 16 such that they are accessible to a person standing on the floor without disrupting the fixtures 16, as can be most easily seen in FIG. 1. Preferably, as illustrated in FIG. 2, each tube 40 intersects the first face 24 of the base 18 at approximately the midpoint of one side of the octagon of the first face 24 and at predetermined distanced radially inward from the edge region 28. In a preferred embodiment, there are eight such tubes 40, one of which is placed at the midpoint of each side of the octagon of the first face 24. By placing the tubes 40 at the midpoint of the sides of the octagon of the first face 24, the weight of the balloon holder 10 may be evenly balanced on the base 18 such that the balloon holder 10 hangs down essentially vertically from the ceiling 14 without any significant tilt to the base 18. Such tilt to the base 18 could enable one or more sticks 42 of balloons 12 to not be retained by the tubes 40 and to fall to the floor.

In a preferred embodiment, at least one tube 40' extends at an acute angle relative to the base 18 and generally outwardly from the center 50 of the base 18. Thus, when sticks 42 are placed in the open end 44 of the tube 40' displaced at such an angle, the balloon 12 attached to the stick 42 will be held at some distance away from the suspension means 22. In this way, designs that are imprinted upon the balloons 12 may be more effectively displayed to any potential customers. Further, the disposition of at least one tube 40' at such an angle aids in the removal of the balloons 12 from the balloon holder 10.

The angular displacement of at least one tube 40' is also advantageous in that this allows for the placement of more balloons 12 in the balloon holder 10. Because balloons 12 naturally accommodate a fixed amount of space when inflated, only so many balloons 12 may be displayed in a given space. If all balloons 12 with attached sticks 42 were retained in balloon holder 10 with the sticks 42 placed in tubes 40 that were disposed perpendicularly to base 18, then the crowding of the inflated balloons would limit the number of balloons 12 that can be displayed.

By including at least one tube 40' that is disposed at an angle to the base 18, and, preferably, several such tubes 40', the available area for display of the balloons 12 is essentially increased because the sticks 42 attached to the balloons 12 are now disposed at an angle other than essentially vertical. This reduces the crowding of the balloons 12 and allows a greater number of balloons 12 to be displayed. Preferably, there are at least four such tubes 40' that are disposed at an angle to the base 18, and these tubes 40' are located at every other side of the octagon of the first face 24. Thus, the tubes 40' with angular displacement are disposed alternately with tubes 40 with a vertical disposition. This allows for smaller balloons, that do not displace as much space, to be placed in the vertical tubes 40, while larger balloons, which tend to be more crowded, may be placed in the angled tubes 40' to reduce crowding.

The acute angle of displacement of these tubes 40' should be greater than 45° with respect to the base 18. In other words, the tubes 40' should be more vertical than horizontal when the base 18 is suspended from the ceiling 14. If the angle of displacement of the tubes 40' is less than about 45°, then there exists a possibility that the sticks 42 that are attached to the balloons 12 and disposed within the open end 44 of the tubes 40' would fall out of the tube 40' and onto the floor.

A mounting structure 22 for suspending the base 18 from the ceiling 14 to a predetermined distance below the ceiling 14 and above the top of the fixtures 16 preferably includes a rod 52 having a length which is selectively determinable to suspend the base 18 at the predetermined distance from the ceiling 14. Preferably, the rod 52 is attached to the base 18 at approximately the center 50 of the base in order to provide for an even distribution of the balloon holder 10 around the rod 52 so that the balloon holder 10 may be suspended from the ceiling 14 without significant tilting, as discussed above with respect to the arrangement of tubes 40,40'. Also, it is preferable if the rod 52 is attached to the base 18 such that the base 18 may be rotated about the axis of the rod 52, allowing access to the balloons 12 that are opposite the person removing the balloons 12.

In one embodiment, the rod 52 is cut to a predetermined length. In another embodiment, the rod 52 has a telescopic construction so that its length may be adjustably varied to accommodate the distance between the fixtures 16 and the ceiling 14 and the desired predetermined distance below the ceiling 14 that the base 18 will be suspended.

The mounting structure 22 further includes an attachment 54 to attach the rod 52 to the ceiling 14. This attachment 54 may be any conventional attachment without departing from the spirit of the invention, but preferably includes a ceiling mount 56 fixed to the ceiling and attached to a first end 60 of a vertical member 58. Preferably, the attachment 54 is easily removable, allowing rapid and easy relocation of the balloon holder. A second end 62 of the vertical member 58 is then attached to the base 18.

The method for displaying and holding balloons 12 and the like at a predetermined distance below the ceiling 14 and above the fixtures 16 extending upwardly from the floor includes installing the ceiling mount 56 at the ceiling 14. The first end 60 of the vertical member 58 is attached to the ceiling mount 56. The length of the vertical member 58 is selected to have a predetermined value so that the second end 62 of the vertical member 58 is disposed just above the fixtures 16 when suspended from the ceiling 14. The balloon holder base 18 is provided at the second end 62 of the vertical member 58, and balloons 12 are attached to the base 18 so that the balloons 12 are disposed above the base 18 and are selectively removable from the balloon holder 10. The step of attaching balloons 12 to the base 18 further includes the step of attaching balloons 12 that contain a gas that is lighter than air, and also includes the step of attaching balloons 12 containing a gas that is not lighter than air.

Figure 3:
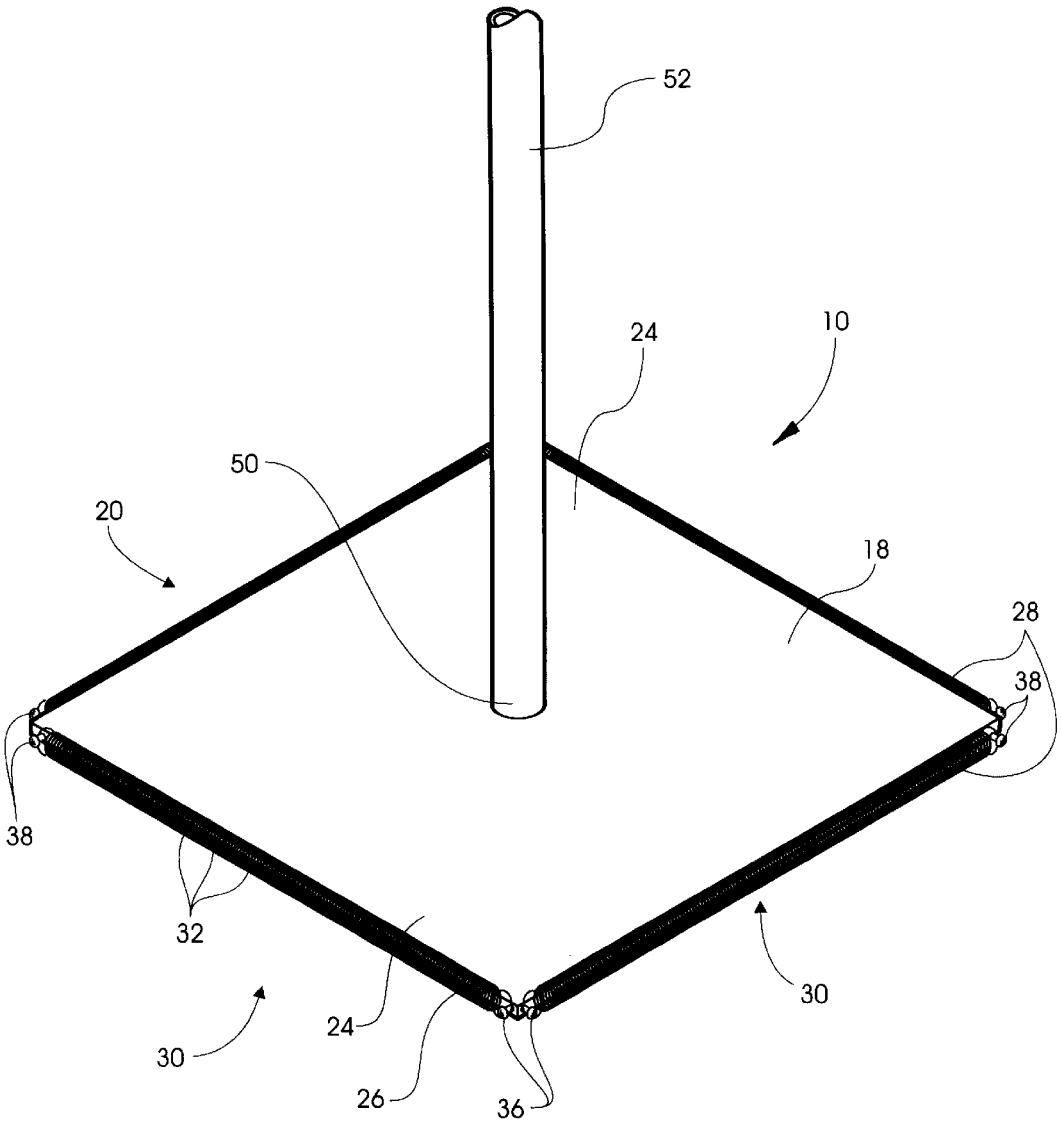
FIG. 3 is a perspective view of an alternate embodiment of the present invention.

In another embodiment, as illustrated in FIG. 3, the retaining structure 20 includes at least one coiled spring 30, as discussed above, but this spring 30 extends substantially the entire length of the edge region 28. It is to be noted that the coiled spring 30 may extend along any portion of the length of the edge region 28 but, preferably, it extends along substantially the entire length of the edge region 28. This maximizes the available locations to removably retain balloons. Most preferably, there are a plurality of coiled springs 30 attached to the edge region 28 so that substantially the entire edge region 28 is provided with a structure for removably retaining balloons.

The shape of the base 18 may be any polyhedron, preferably the rectangular prism illustrated in FIG. 3, but the shape is not critical to the novelty of the invention, and any one of a wide variety of possible shapes could be used.

It will be recognized that the present invention is capable of removably retaining and displaying balloons of many different shapes and sizes and that are filled with many different gases. The present invention also accommodates many different types of balloon attachments. For example, balloons often have strings attached to them, but may also have ribbons or other string-like elements attached. These strings, ribbons, etc., may be of different lengths and, in fact, it is preferred that they be of different lengths to minimize crowding and maximize exposure to the prospective customers by presenting the balloons at different heights. Likewise, the sticks that are often attached to balloons may be, and are preferred to be, of various lengths and may also be of various materials with various diameters. The present invention is able to display balloons with a wide variety of attachment means.

It will also be recognized that the balloon holder 10 may be provided in a variety of colors or be multi-colored to enhance the aesthetically visually pleasing nature of the balloon holder 10 and to draw attention to its presence. Further, it should be recognized that brand names, trademarks, etc., may be emblazoned upon any portion of the balloon holder 10 in order to provide an advertising medium.

As illustrated in FIG. 1, the present invention is particularly suitable for placement above fixtures, such as candy or magazine racks, located in supermarket checkout aisles. Such placement above fixtures at or about eye level and at the point of sale greatly increases sales of the items so displayed. Also, such placement generally ensures that children do not have access to the display and, thus, will not disrupt and scatter or break the product. The display of balloons in such location by the present invention does not displace existing displays, and this location is exceptionally conducive to facilitating impulse sales. It is to be noted that the invention is not limited to such placement, location at other sites is also anticipated, but such placement has been observed to produce outstanding results.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A ceiling-mounted balloon holder to removably retain balloons attached to tethers at a predetermined distance below said ceiling and at a location above fixtures extending upwardly from a floor, comprising:

(a) a base suspendable from said ceiling and disposed above said fixtures such that said balloon holder is accessible to a person standing on said floor without disrupting said fixtures;

(b) means for removably retaining balloons on said base, said means including a receiver formed thereon to permit said balloon tethers to be inserted into said receiver and to be releasably retained thereat; and (c) means for suspending said base from said ceiling to said predetermined distance therebelow such that said base is positionable between said ceiling and the top of said fixture located on said floor.

2. The balloon holder of claim 1, wherein said base is a polyhedron with two parallel, congruent faces and all other faces parallelograms.

3. The balloon holder of claim 2, wherein said faces are generally parallel to said ceiling.

4. The balloon holder of claim 1, wherein said suspension means includes a rod having a length which is selectively determinable to suspend said base at said predetermined distance from said ceiling.

5. The balloon holder of claim 4, wherein said rod is a telescoping rod.

6. A ceiling-mounted balloon holder to removably retain balloons and the like at a predetermined distance below said ceiling and at a location above fixtures extending upwardly from a floor, comprising:

(a) a base suspendable from said ceiling and disposed above said fixtures such that said balloon holder is accessible to a person standing on said floor without disrupting said fixtures and including:

(1) a plurality of tubes extending generally toward said ceiling and being open at an end nearest said ceiling for receiving and holding sticks attached to said balloons, and (2) a plurality of coiled springs each having a plurality of coils spaced from one another at a distance that will retain therebetween a string-like element attached to at least one of said balloons;

(b) a telescoping rod attached to said ceiling at one end and to said base at the other end for suspending said base from said ceiling to said predetermined distance therebelow such that said base is positionable between said ceiling and the top of said fixture located on said floor; and (c) means for attaching said telescoping rod to said ceiling.

7. The balloon holder of claim 6, wherein said base is generally an octagonal prism, with a first face disposed toward said ceiling and a second face disposed away from said ceiling and an edge region thereabout, both faces generally parallel to said ceiling, each tube positioned to intersect said first face at approximately the midpoint of one side of said octagon at a predetermined distance radially inwardly from said edge region, said springs being attached to said edge region.

8. A ceiling-mounted balloon holder to removably retain balloons and the like at a predetermined distance below said ceiling and at a location above fixtures extending upwardly from a floor, comprising:

(a) a planar platform suspendable from said ceiling and disposed above said fixtures such that said balloon holder is accessible to a person standing on said floor without disrupting said fixtures, said planar platform having a first face, a second face, and an edge;

(b) a plurality of tubes attached to said platform and extending outwardly from said first face, said tubes being closed at one end and open at the other end and having a size and angular disposition for holding sticks attached to said balloons;

(c) a plurality of coiled springs attached to said edge, each spring having a plurality of coils spaced from one another at a distance that will retain therebetween a string-like element attached to at least one of said balloons;

(d) means for suspending said platform from said ceiling to said predetermined distance therebelow such that said base is positionable between said ceiling and the top of said fixture located on said floor.

9. A method for removably retaining balloons attached to tethers at a predetermined distance below a ceiling and above a fixture extending upwardly from a floor, comprising the steps of:.

(a) installing a ceiling mount on said ceiling;

(b) attaching a first end of a vertical member to said ceiling mount;

(c) selecting a length of said vertical member having a predetermined value such that a second end of said vertical member is disposed just above said fixture;

(d) providing a balloon holder base at said second end of said vertical member, said balloon holder having a receiver formed thereon to permit said balloon tethers to be inserted into said receiver and to be releasably retained thereat; and (e) attaching balloons to said balloon holder base by inserting said tethers into said receiver so that said balloons are disposed above said holder and are selectively removable from said holder.

10. The method of claim 9, wherein the step of attaching balloons includes attaching balloons containing a gas that is lighter than air.

11. The method of claim 9, wherein the step of attaching balloons includes attaching balloons containing a gas that is not lighter than air.

12. A ceiling-mounted balloon holder to removably retain balloons and the like at a predetermined distance below said ceiling and at a location above fixtures extending upwardly from a floor, comprising:

(a) a base being generally an octagonal prism, with a first face disposed toward said ceiling and a second face disposed away from said ceiling and an edge region thereabout, both faces generally parallel to said ceiling, said base disposed between said ceiling and the top of said fixtures such that said balloon holder is accessible to a person standing on said floor without disrupting said fixtures;

(b) a plurality of tubes, each tube positioned to intersect said first face and extending generally toward said ceiling, at least one tube being disposed at an acute angle relative to said base, said tubes being open at an end nearest said ceiling and having a size and angular disposition for receiving and holding sticks that are attached to balloons filled with a gas that is not lighter than air, at least one tube having a first diameter and at least one other tube having a second diameter different from said first diameter;

(c) a plurality of coiled springs, each said spring having a plurality of coils spaced from one another at a distance that will retain therebetween a string-like element attached to at least one of said balloons, said springs being attached to said edge region to secure said string-like elements attached to balloons filled with a gas that is lighter than air, (d) a telescoping rod with one end attached to said ceiling and the other end attached to said base for suspending said base from said ceiling to said predetermined distance, said rod being adjustable to a predetermined length; and (e) means for attaching said telescoping rod to said ceiling.

13. A ceiling-mounted balloon holder to removably retain balloons attached to tethers at a predetermined distance below said ceiling and at a location above fixtures extending upwardly from a floor, comprising:

(a) a base suspendable from said ceiling and disposed above said fixtures such that said balloon holder is accessible to a person standing on said floor without disrupting said fixtures;

(b) means for removably retaining balloons on said base, said means including a receiver formed to permit said balloon tethers to be inserted into said receiver and to be releasably retained thereat and comprising at least one coiled spring having a plurality of coils spaced from one another at a distance that will retain therebetween a string-like element attached to at least one of said balloons; and (c) means for suspending said base from said ceiling to said predetermined distance therebelow such that said base is positionable between said ceiling and the top of said fixture located on said floor.

14. A ceiling-mounted balloon holder to removably retain balloons attached to tethers at a predetermined distance below said ceiling and at a location above fixtures extending upwardly from a floor, comprising:

(a) a base suspendable from said ceiling and disposed above said fixtures such that said balloon holder is accessible to a person standing on said floor without disrupting said fixtures;

(b) means for removably retaining balloons on said base, said means including a receiver formed to permit said balloon tethers to be inserted into said receiver and to be releasably retained thereat and comprising a plurality of tubes attached to said base, said tubes having a size and angular disposition for receiving and holding sticks attached to said balloons; and (c) means for suspending said base from said ceiling to said predetermined distance therebelow such that said base is positionable between said ceiling and the top of said fixture located on said floor.

15. The balloon holder of claim 14, wherein said means for removably retaining balloons includes at least one coiled spring having a plurality of coils spaced from one another at a distance that will retain therebetween a string-like element attached to at least one of said balloons.

16. The balloon holder of claim 14, wherein said tubes extend generally toward said ceiling and are open at an end nearest said ceiling to accommodate said sticks that are attached to balloons.

17. The balloon holder of claim 16, wherein at least one said tube extends generally toward said ceiling at an acute angle relative to said base and generally outwardly from the center of said base.

18. The balloon holder of claim 14, wherein said tubes include at least one tube with a first diameter and at least one other tube with a second diameter different from said first diameter.

19. The balloon holder of claim 14, wherein said base is generally an octagonal prism, with a first face disposed toward said ceiling and a second face disposed away from said ceiling and an edge region thereabout, each tube positioned to intersect said first face at approximately the midpoint of one side of said octagon and at a predetermined distance radially inwardly from said edge region.

* * * * *